US012071879B2

(12) United States Patent
Ishii et al.

(10) Patent No.: US 12,071,879 B2
(45) Date of Patent: Aug. 27, 2024

(54) NOX GENERATION AMOUNT CONTROL DEVICE

(71) Applicant: ISUZU MOTORS LIMITED, Tokyo (JP)

(72) Inventors: Daiki Ishii, Fujisawa (JP); Takao Onodera, Fujisawa (JP); Yoshifumi Hanamura, Fujisawa (JP); Kazushige Yamaura, Fujisawa (JP); Satoshi Hanawa, Fujisawa (JP); Hotaka Saitou, Fujisawa (JP)

(73) Assignee: ISUZU MOTORS LIMITED, Tokyo (JP)

( * ) Notice: Subject to any disclaimer, the term of this patent is extended or adjusted under 35 U.S.C. 154(b) by 82 days.

(21) Appl. No.: 18/453,492

(22) Filed: Aug. 22, 2023

(65) Prior Publication Data

US 2024/0084725 A1 Mar. 14, 2024

(30) Foreign Application Priority Data

Sep. 12, 2022 (JP) ..... 2022-144525

(51) Int. Cl.
*F01N 11/00* (2006.01)

(52) U.S. Cl.
CPC ..... *F01N 11/007* (2013.01); *F01N 2550/02* (2013.01)

(58) Field of Classification Search
CPC ..... F01N 11/007; F01N 11/00; F01N 9/00; F01N 3/0814; F01N 3/0842; F01N 2550/02; F01N 2560/026; F01N 2570/14; F01N 2900/14; F01N 2900/1402; F01N 2900/1614; Y02T 10/12; Y02T 10/40
See application file for complete search history.

(56) References Cited

U.S. PATENT DOCUMENTS 10,787,164 B2 * 9/2020 Jang ..... B01D 53/9418
11,319,888 B2 * 5/2022 Graichen ..... F02D 41/1406
11,687,688 B2 * 6/2023 Pekar ..... F02D 41/26 703/11

(Continued)

FOREIGN PATENT DOCUMENTS

JP 2010-112290 A 5/2010
JP 2010-138864 A 6/2010
JP 2019-015239 A 1/2019

*Primary Examiner* — Dapinder Singh
(74) *Attorney, Agent, or Firm* — Procopio, Cory, Hargreaves & Savitch LLP

(57) ABSTRACT

A NOx generation amount control device includes: a cumulative amount calculating part calculating a cumulative NOx amount obtained by adding together a plurality of NOx exhaust amounts calculated for each prescribed time interval; a specifying part specifying a target value of the cumulative NOx amount associated with a movement distance of a moving body or an output value of an engine; an estimating part estimating a predicted NOx amount indicating a predicted cumulative NOx amount based on a rotation speed of the engine and a fuel injection amount; a judging part judging whether the sum of the predicted NOx amount and the cumulative NOx amount exceeds the target value; and a determining part determining a scheduled NOx exhaust amount and determining at least one of an opening degree of the EGR valve and an opening degree of a turbocharger.

12 Claims, 6 Drawing Sheets

(56) References Cited

U.S. PATENT DOCUMENTS

| | | | | |
|---|---|---|---|---|
| 2002/0029564 | A1* | 3/2002 | Roth | F01N 3/20 60/285 |
| 2011/0203260 | A1 | 8/2011 | Umemoto et al. | |
| 2017/0248091 | A1 | 8/2017 | Segtrop et al. | |
| 2018/0298870 | A1* | 10/2018 | Dane | F02P 5/045 |
| 2019/0010886 | A1 | 1/2019 | Matsuzawa | |

* cited by examiner

NOX GENERATION AMOUNT CONTROL DEVICE

CROSS-REFERENCE TO RELATED APPLICATIONS

The present application claims priority to Japanese Patent Application number 2022-144525, filed on Sep. 12, 2022, contents of which are incorporated herein by reference in its entirety.

BACKGROUND OF THE INVENTION

The present disclosure relates to a NOx generation amount control device. Conventionally, there has been known a control parameter setting apparatus that sets control parameters of an engine according to an operation mode in an exhaust gas test measurement of a vehicle, and operates the engine so as not to exceed a target value of a total amount of NOx exhausts (for example, see Japanese Unexamined Patent Application Publication No. 2010-138864).

In the conventional control parameter setting apparatus, the engine can be operated so that the total amount of NOx discharged while the vehicle travels over a prescribed travel distance in a specific driving pattern does not exceed the target value. However, in recent exhaust gas test measurements, a target value of the total NOx exhaust amount is determined for each travel distance of a vehicle traveling in a plurality of driving patterns. As a result, there is a problem that the engine may be controlled so as to exhaust a NOx exhaust amount lower than the NOx exhaust amount suitable for the travel state, so that fuel consumption is not improved.

BRIEF SUMMARY OF THE INVENTION

The present disclosure has been made in view of the above circumstances, and an object of the present disclosure is to control the exhaust of NOx to be an amount suitable for the travel state.

A NOx generation amount control device according to an aspect of the present disclosure is a NOx generation amount control device including: an exhaust amount calculating part that calculates a NOx exhaust amount based on a NOx concentration detected at a downstream side of a purification apparatus provided in an exhaust passage in which exhaust gas of an engine flows, and on an exhaust amount of the engine, at each prescribed time interval; a cumulative amount calculating part that calculates a cumulative NOx amount obtained by adding together a plurality of NOx exhaust amounts; a specifying part that specifies a target value for the cumulative NOx amount associated with a movement distance of a moving body including the engine or an output value of the engine; an estimating part that estimates a predicted NOx amount indicating a predicted cumulative NOx amount at a prescribed timing or at a prescribed travel distance based on a rotation speed of the engine and a fuel injection amount; a judging part that judges whether a sum of the predicted NOx amount and the cumulative NOx amount exceeds a target value; and a determining part that determines a scheduled NOx exhaust amount for each prescribed time interval based on a judgment result of the judging part, an upper limit value of NOx exhaust, and a difference between the target value and the cumulative NOx amount, and determines at least one of an opening degree of a valve provided in a passage for recirculating the exhaust gas to the engine and an opening degree of a turbocharger, corresponding to the scheduled NOx exhaust amount.

DETAILED DESCRIPTION OF THE INVENTION

Hereinafter, the present disclosure will be described through exemplary embodiments, but the following exemplary embodiments do not limit the invention according to the claims, and not all of the combinations of features described in the exemplary embodiments are necessarily essential to the solution means of the invention.

<Configuration of the NOx Generation Amount Control System 1>

Figure 1:
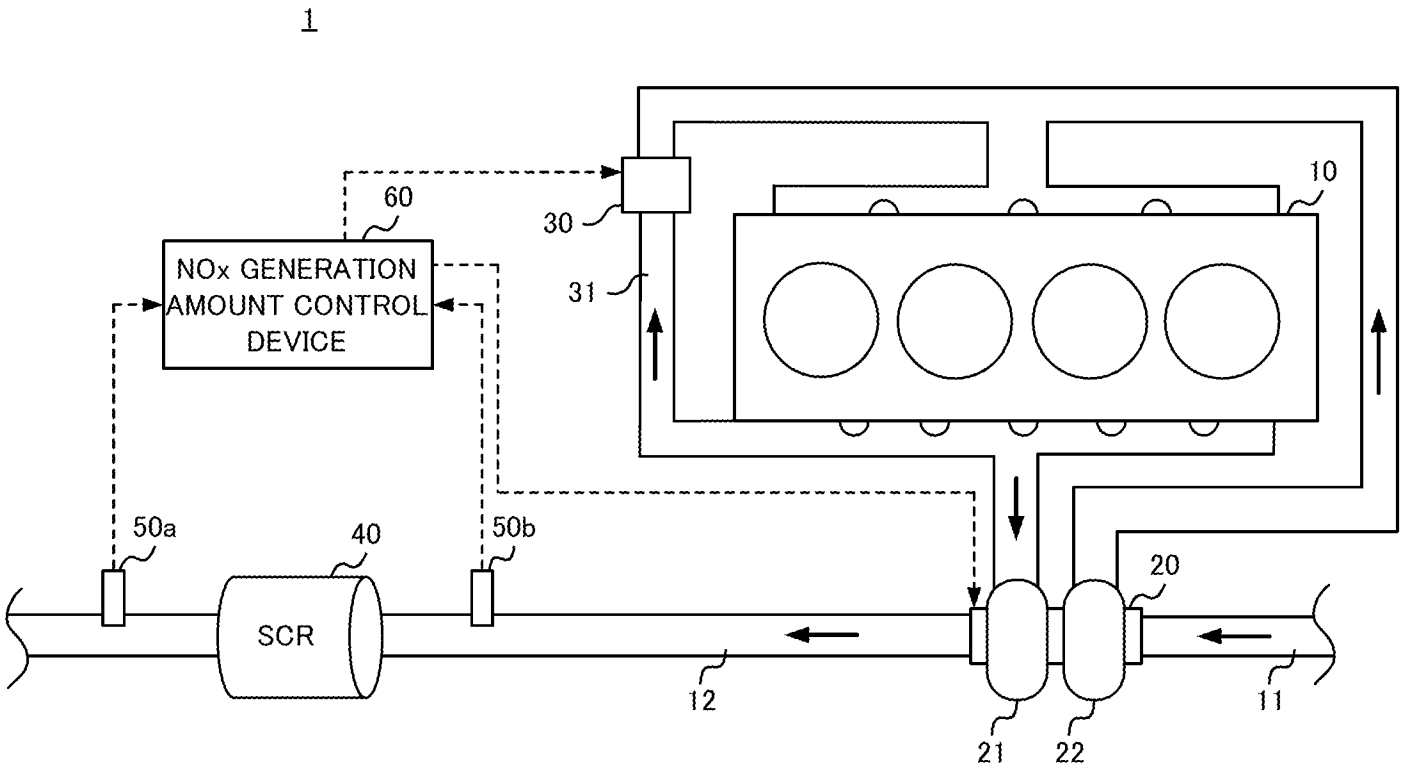
FIG. 1 is a schematic diagram showing a configuration of a NOx generation amount control system 1 according to an embodiment.

FIG. 1 is a schematic diagram showing a configuration of a NOx generation amount control system 1 according to an embodiment. As shown in FIG. 1, the NOx generation amount control system 1 includes an engine 10, a turbocharger 20, an EGR (Exhaust Gas Recirculation) valve 30, an SCR (Selective Catalytic Reduction) apparatus 40, a NOx sensor 50*a*, a NOx sensor 50*b*, and a NOx generation amount control device 60. The NOx generation amount control system 1 is mounted in a vehicle, and controls the generation amount of NOx contained in the exhaust gas of the engine 10.

The engine 10 is an internal combustion engine that generates power by combustion and expansion of a mixture of fuel and intake gas (air).

The turbocharger 20 is a supercharger that utilizes a flow of exhaust gas to increase the density of intake gas. The turbocharger 20 includes a turbine 21 provided in an exhaust passage 12 and a compressor 22 provided in an intake passage 11. The turbine 21 receives energy of the exhaust gas and rotates. The compressor 22 is connected to the turbine 21 via a connection shaft. When the compressor 22 rotates with the turbine 21, the intake gas is compressed. In the turbocharger 20, the exhaust gas amount and the intake gas amount are adjusted by having the NOx generation amount control device 60 control the opening degrees of the turbine 21 and the compressor 22.

The EGR valve 30 is a valve included in the EGR apparatus 31. In the EGR apparatus 31, the EGR gas amount is adjusted by having the NOx generation amount control device 60 control the opening degree of the EGR valve 30.

The SCR apparatus 40 is a purification apparatus that converts NOx in the exhaust gas into harmless nitrogen, through a reduction reaction. The SCR apparatus 40 includes a reduction catalyst that promotes a reduction reaction between ammonia and NOx. Ammonia generated from urea water is adsorbed by the reduction catalyst. The reduction catalyst reduces NOx to nitrogen and water by using the adsorbed ammonia to reduce NOx exhausts.

The NOx sensor 50*a* and the NOx sensor 50*b* detect the concentration of NOx in the exhaust gas. The NOx sensor 50*a* is provided on the downstream side of the SCR apparatus 40 in the exhaust passage 12, and the NOx sensor 50*b* is provided on the upstream side of the SCR apparatus 40 in the exhaust passage 12. As an example, the NOx sensor 50*a* and the NOx sensor 50*b* detect the concentration of NOx by detecting oxygen decomposed from NOx in the exhaust gas taken in the chamber inside.

The NOx generation amount control device 60 controls the NOx generation amount based on the NOx concentration detected by the NOx sensors 50*a* and 50*b*. The NOx generation amount control device 60 controls the NOx generation amount by increasing or decreasing at least one of the opening degree of the turbine 21, the opening degree of the compressor 22, and the opening degree of the EGR valve 30. For example, the NOx generation amount control device 60 increases the opening degree of the EGR valve 30 when the NOx generation amount is reduced, and decreases the opening degree of the EGR valve 30 when the NOx generation amount is increased.

In the RDE (Real Driving Emission) test, a regulation value of the total amount of NOx exhaust is determined for each engine output or for each movement distance (hereinafter referred to as "travel distance") of a vehicle traveling in a plurality of travel patterns. Since the travel patterns include a travel pattern with a low NOx exhaust amount (for example, a pattern in which the vehicle travels at a constant speed) and a travel pattern with a high NOx exhaust amount (for example, a pattern with a high frequency of starting and stopping), the vehicle is controlled to exhaust a NOx exhaust amount lower than the NOx exhaust amount suitable for the travel pattern. As a result, the vehicle travels so as not to exceed the regulation value of the total NOx exhaust amount for each travel distance or engine output, but the fuel consumption does not improve.

On the other hand, the NOx generation amount control device 60 calculates the difference between the regulation value and the total NOx exhaust amount based on the NOx concentration acquired from the NOx sensor 50*a* and the NOx sensor 50*b* at every prescribed time interval, and determines a NOx exhaust amount (hereinafter referred to as "scheduled NOx exhaust amount") that does not exceed the regulation value. Then, the NOx generation amount control device 60 determines at least one of the opening degree of the turbine 21, the opening degree of the compressor 22, and the opening degree of the EGR valve 30 corresponding to the determined scheduled NOx exhaust amount. Thus, the vehicle exhausts a NOx exhaust amount suitable for the travel pattern, and the fuel consumption is improved. Hereinafter, the configuration and operation of the NOx generation amount control device 60 will be described in detail.

<Configuration of the NOx Evolution Control Unit 60>

Figure 2:
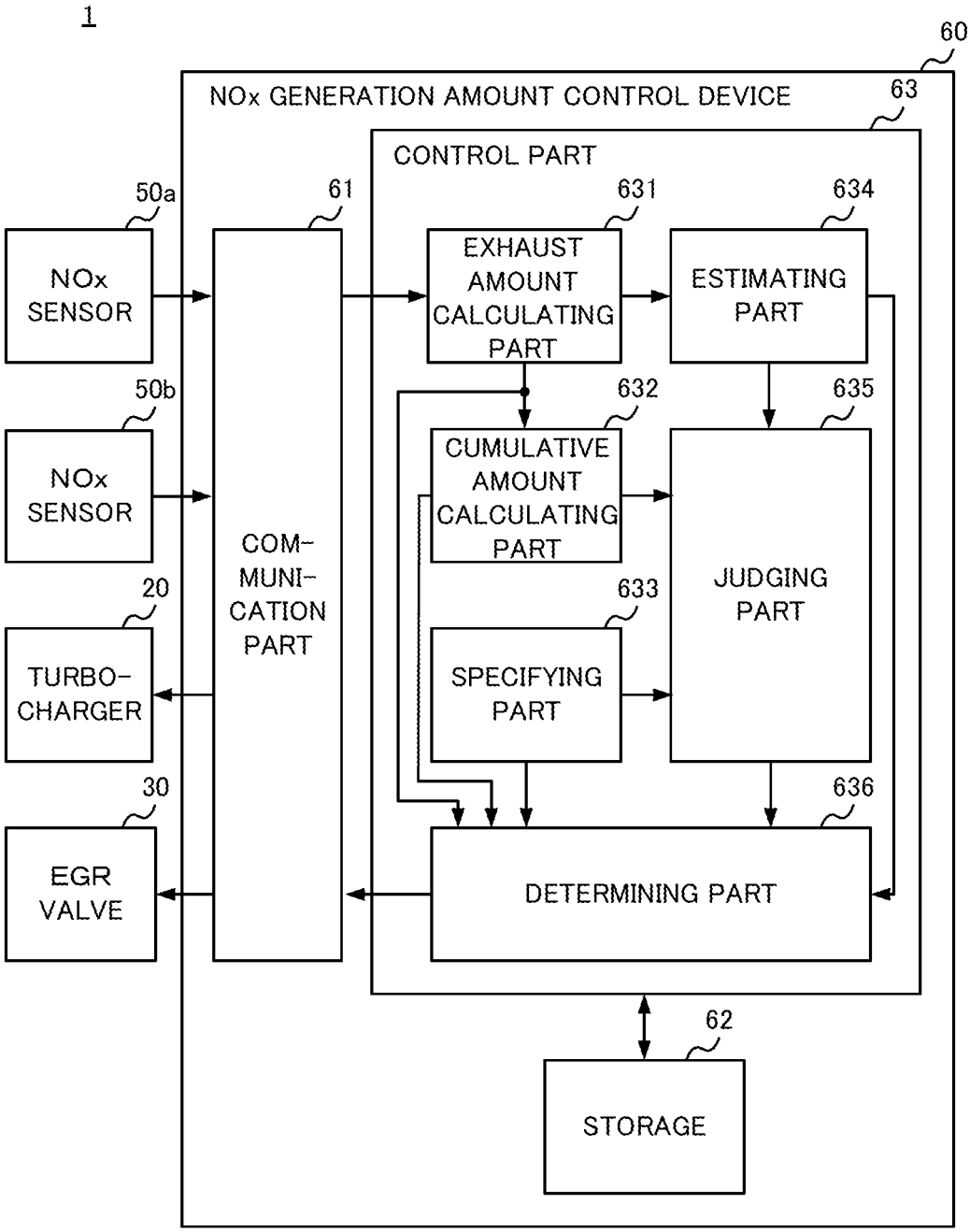
FIG. 2 is a diagram showing a configuration of a NOx generation amount control device 60.

FIG. 2 is a diagram showing a configuration of the NOx generation amount control device 60. The NOx generation amount control device 60 includes a communication part 61, a storage 62, and a controller 63.

The communication part 61 includes a communication apparatus for transmitting and receiving information via a network or a digital signal transmission bus. The communication apparatus is, for example, a CAN (Controller Area Network) controller.

The storage 62 includes a storage medium such as ROM (Read Only Memory), RAM (Random Access Memory), HDD (Hard Disk Drive), or SSD (Solid State Drive). The storage 62 stores a program executed by the controller 63. The storage 62 stores various types of information necessary for the NOx generation amount control device 60 to determine the opening degree of the turbine 21, the opening degree of the compressor 22, and the opening degree of the EGR valve 30.

The controller 63 is, for example, a processor such as a CPU (Central Processing Unit) or an ECU (Electronic Control Unit). The controller 63 functions as an exhaust amount calculating part 631, a cumulative amount calculating part 632, a specifying part 633, an estimating part 634, a judging part 635, and a determining part 636 by executing a program stored in the storage 62. The configuration of each part implemented by the controller 63 will be described below.

The exhaust amount calculating part 631 calculates the exhaust amount of NOx based on the NOx concentration detected at the downstream side of the SCR apparatus 40 provided in the exhaust passage 12 through which the exhaust gas of the engine 10 flows and the exhaust amount of the engine 10, at prescribed time intervals. The prescribed time interval is smaller than a time period from when a control unit such as an ECU outputs an instruction to change the opening degree to the EGR valve 30, the turbine 21, or the compressor 22 to when the opening degree changes, and is, for example, an interval of less than 0.1 seconds.

As an example, the exhaust amount calculating part 631 calculates the NOx exhaust amount based on the NOx concentration detected by the NOx sensor 50*a* at prescribed time intervals and the exhaust amount of the engine 10 stored in the storage 62. The exhaust amount calculating part 631 may calculate the NOx exhaust amount and a NOx purification rate based on the NOx concentration detected by the NOx sensors 50*a* and 50*b* and the exhaust flow rate of the exhaust passage 12 specified by an exhaust flow rate measuring device (not shown) provided in the vehicle.

The exhaust amount calculating part 631 calculates the NOx purification rate with the SCR apparatus 40, based on the NOx concentration detected on the upstream side of the SCR apparatus 40 and the NOx concentration detected on the downstream side of the SCR apparatus 40. For example, the exhaust amount calculating part 631 calculates the NOx purification rate based on the difference between the NOx concentrations detected by the NOx sensors 50*a* and 50*b*.

The cumulative amount calculating part 632 calculates a cumulative NOx amount obtained by adding together a plurality of NOx exhaust amounts calculated by the exhaust amount calculating part 631. As an example, the cumulative amount calculating part 632 calculates a cumulative NOx amount obtained by adding together a plurality of NOx exhaust amounts calculated at prescribed time intervals from the start of the engine 10 to the current timing. The cumulative amount calculating part 632 stores, in the storage 62, at least one of the cumulative NOx amount at each timing, the cumulative NOx amount for each travel distance of the vehicle, and the cumulative NOx amount for each output value of the engine 10.

The specifying part 633 specifies a target value for the cumulative NOx amount associated with the travel distance of the vehicle including the engine 10 or the output value of the engine 10. The target value is, for example, a target value corresponding to a regulation value of the NOx exhaust amount determined in an exhaust gas test such as an RDE test, and is the same value as the regulation value or a value obtained by multiplying the regulation value by a prescribed ratio (e.g., 90%).

As an example, the specifying part 633 acquires the travel distance or the output value of the engine 10 stored in the storage 62 at prescribed time intervals. Then, the specifying part 633 specifies the target value by referencing a target value table, which is stored in the storage 62, in which the travel distance of the vehicle or the output value of the engine 10 and the target value are associated with each other.

The estimating part 634 estimates, based on the rotation speed of the engine 10 and the fuel injection amount, a predicted NOx amount indicating a predicted cumulative amount of NOx at a prescribed time or a prescribed travel distance. The prescribed time is, for example, 0.1 seconds after the control unit such as the ECU outputs an instruction to change the opening degree to the EGR valve 30, the turbine 21, or the compressor 22. The prescribed travel distance is a distance that the vehicle travels in a prescribed time, for example, a distance that the vehicle travels in 0.1 seconds. In this embodiment, an operation of estimating the predicted NOx amount at prescribed times will be described. As an example, the estimating part 634 calculates an integrated value of the NOx exhaust amount based on the engine speed and the fuel injection amount from the current timing to a timing before the prescribed time interval, and adds the calculated integrated value to the cumulative NOx amount at the current timing, thereby estimating the predicted NOx amount from the current timing to a timing after the prescribed time interval.

Figure 3:
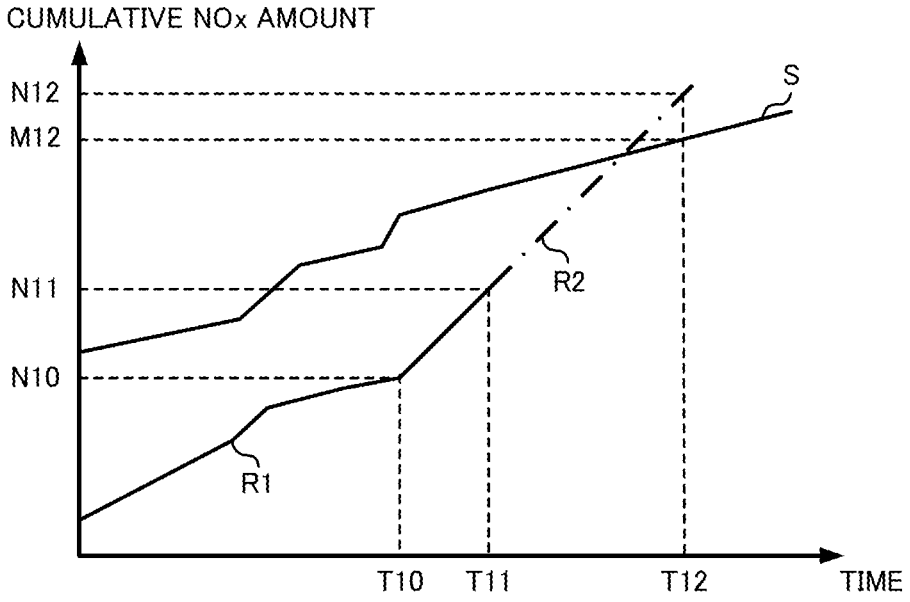
FIG. 3 is a diagram for explaining the operation of estimating a predicted NOx amount.

FIG. 3 is a diagram for explaining an operation of estimating a predicted NOx amount. The horizontal axis of FIG. 3 represents time. The timing T11 is the current timing. The vertical axis of FIG. 3 represents the cumulative NOx amount. FIG. 3 shows the target value S, the cumulative NOx amount R1 (solid line) and the predicted NOx amount R2 (single-dash chain line) associated with the timing. The target value S at timings before the timing T11 is the target value S specified for each prescribed time interval by the specifying part 633, and the target value S at timings after the timing T11 is the target value S estimated by the estimating part 634 based on the target value S per unit time calculated from the target value S from the timing T10 to the timing T11.

As an example, by referencing the storage 62, the estimating part 634 acquires the engine speed and the fuel injection amount from the current timing T11 to the timing T10, which is before the prescribed time interval, and calculates the integrated value (cumulative amount N11—cumulative amount N10) of the NOx exhaust amount at the prescribed time interval. Then, the estimating part 634 identifies the NOx exhaust amount per unit time based on the integrated value and a prescribed time interval, and estimates the predicted NOx amount R2 (cumulative amount N12—cumulative amount N11) within a prescribed time (a time from the timing T11 to the timing T12).

The estimating part 634 may reference the NOx exhaust amount stored in the storage 62 to calculate the integrated value of the NOx exhaust amount (cumulative amount N11—cumulative amount N10) from the timing T10 to the timing T11, and identify the NOx exhaust amount per unit time. Further, the estimating part 634 may identify the NOx exhaust amount calculated from the engine speed and the fuel injection amount at the current timing (timing T11) or the NOx exhaust amount stored in the storage 62 in association with the current timing as the NOx exhaust amount per unit time.

The estimating part 634 may determine the predicted NOx amount R2 on the downstream side of the SCR apparatus 40 based further on the purification rate calculated by the exhaust amount calculating part 631. For example, the estimating part 634 determines the predicted NOx amount R2 by integrating the NOx exhaust amount calculated from the engine speed and fuel injection amount and the ratio indicated by the purification rate. By having the estimating part 634 operate in this manner, it is possible to calculate the predicted NOx amount R2 with high accuracy.

The judging part 635 judges whether the sum of the predicted NOx amount R2 and the cumulative NOx amount R1 exceeds the target value S. For example, the judging part 635 judges whether this sum exceeds the target value S at a timing when a prescribed time has elapsed from the current timing. For example, in FIG. 3, the judging part 635 judges that the sum of the cumulative NOx amount R1 and the predicted NOx amount R2 at the timing T12 (the cumulative amount N12) exceeds the target value S (the cumulative amount M12) at the timing T12.

Figure 4:
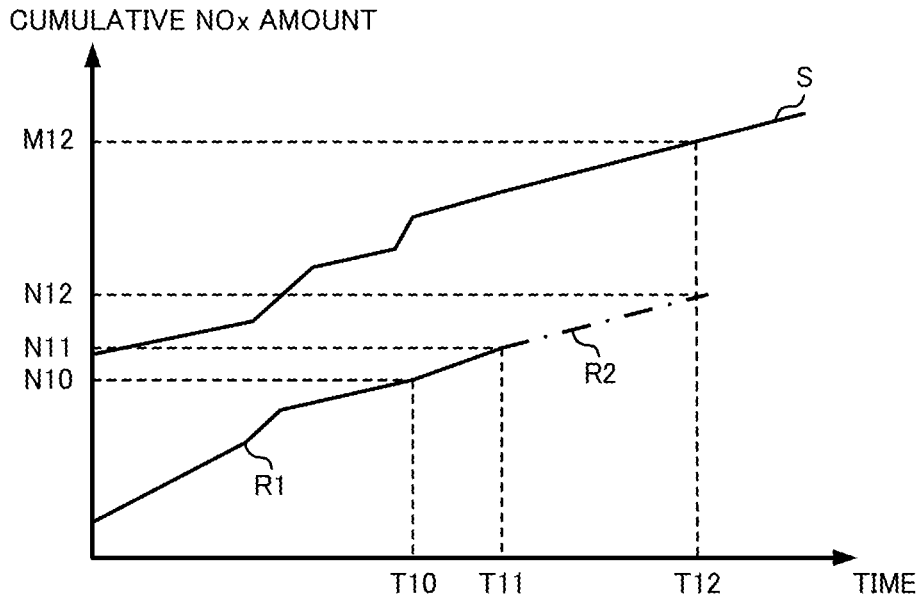
FIG. 4 is a diagram showing a case where a sum of the predicted NOx amount R2 and a cumulative NOx amount R1 does not exceed a target value S.

FIG. 4 is a diagram showing a case where the sum of the predicted NOx amount R2 and the cumulative NOx amount R1 does not exceed the target value S. In such a case, the judging part 635 judges that the sum (cumulative amount N12) of the cumulative NOx amount R1 and the predicted NOx amount R2 at the timing T12 does not exceed the target value S (cumulative amount M12) at the timing T12.

The determining part 636 determines the scheduled NOx exhaust amount for each prescribed time interval based on the judgment result of the judging part 635, a NOx exhaust upper limit value, and a difference between the target value S and the NOx integrated amount R1. If the judging part 635 judges that the sum of the cumulative NOx amount R1 and the predicted NOx amount R2 does not exceed the target value S, the determining part 636 determines a scheduled NOx exhaust amount that is smaller than the difference between the target value S and the cumulative NOx amount R1 and is larger than the scheduled NOx amount R2 that has the exhaust upper limit value as the upper limit.

Figure 5:
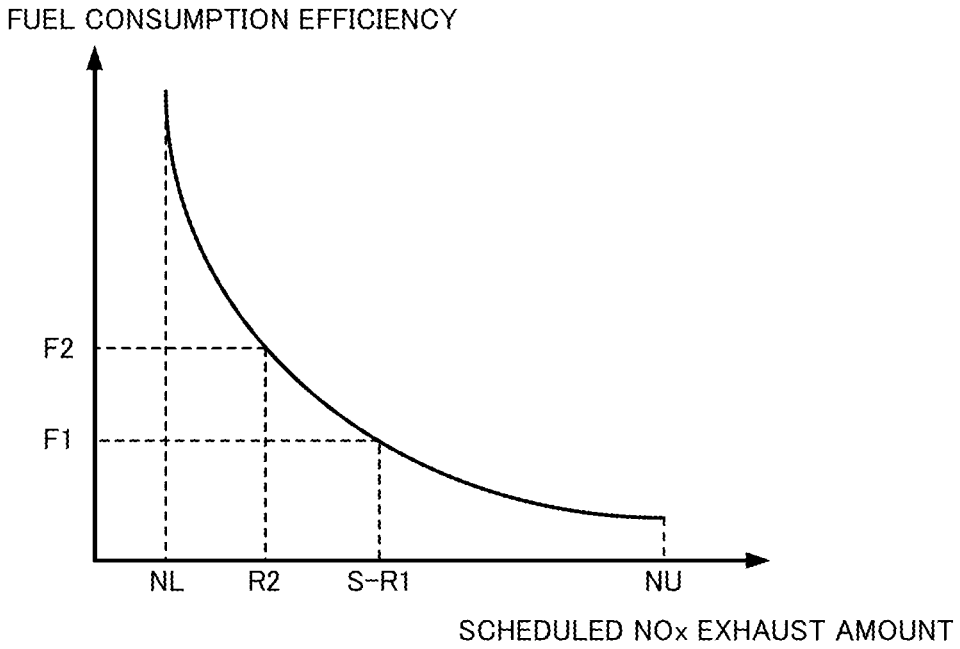
FIG. 5 is a diagram for explaining an operation of determining a scheduled NOx exhaust amount.

FIG. 5 is a diagram for explaining an operation of determining a scheduled NOx exhaust amount. In FIG. 5, the horizontal axis represents the scheduled NOx exhaust amount, and the vertical axis represents the fuel consumption rate. The NOx exhaust lower limit value NL and the NOx exhaust upper limit value NU are shown on the horizontal axis of FIG. 5. The fuel consumption rate is the fuel consumption per unit distance or unit work amount, and in FIG. 5, the fuel consumption F2 is larger than the fuel consumption F1. The exhaust upper limit value NU corresponds to the NOx exhaust amount when the fuel consumption rate is smallest. The exhaust lower limit value NL is the minimum generation amount of NOx generated when the engine 10 is operated in order to drive the vehicle. For example, at the timing T11 shown in FIG. 4, the judging part 635 judges that the sum of the cumulative NOx amount R1 and the predicted NOx amount R2 at the timing T12 (i.e., the cumulative amount N12) does not exceed the target value S (i.e., the cumulative amount M12). Subsequently, the determining part 636 determines a scheduled NOx exhaust amount that is larger than the scheduled NOx exhaust amount R2 shown in FIG. 5 and smaller than the difference between the target value S and the NOx integrated value S1 (scheduled NOx exhaust amount S shown in FIG. 5 minus R1).

By having the determining part 636 operate in this manner, the NOx generation amount control device 60 can determine the scheduled NOx generation amount so as not to exceed the regulation value of the NOx exhaust amount for each travel distance or each output value of the engine 10. Further, since the NOx exhaust amount can be determined such that the NOx exhaust amount increases (i.e., the fuel consumption rate decreases) within a range not exceeding the regulation value of the NOx exhaust amount, the fuel consumption of the vehicle can be improved.

When the judging part 635 judges that the sum of the cumulative NOx amount R1 and the predicted NOx amount R2 exceeds the target value S, the determining part 636 determines a scheduled NOx exhaust amount that corresponds to the NOx exhaust lower limit value NL. Specifically, at the timing T11 shown in FIG. 3, the judging part 635 judges that the sum of the cumulative NOx amount R1 and the predicted NOx amount R2 at the timing T12 (i.e., the cumulative amount N12) exceeds the target value S (i.e., the cumulative amount M12). Subsequently, the determining part 636 determines the exhaust lower limit value NL shown in FIG. 5 as the scheduled NOx exhaust amount. By having the determining part 636 operate in this manner, the possibility of the NOx exhausts exceeding the regulation value can be reduced.

The determining part 636 may determine, as the scheduled NOx exhaust amount at a current timing, the scheduled NOx exhaust amount whose sum with the NOx integrated amount is closest to the target value S and not exceeding the target value S among a plurality of scheduled NOx exhaust amounts determined after the engine 10 starts operating. Specifically, at the timing T11 (current timing) shown in FIG. 3, the determining part 636 specifies a plurality of scheduled NOx exhaust amounts determined at each prescribed time interval in a time period from a timing when the engine starts to the timing T11. The determining part 636 determines, as a scheduled NOx exhaust amount at the timing T11, the scheduled NOx exhaust amount whose sum with the NOx integrated amount N11 at the timing of T11 is closest to the target value S at the timing of T12 and not exceeding the target value S among the specified plurality of scheduled NOx exhaust amounts. Since the determining part 636 operates in this manner, the fuel consumption rate, which becomes smaller as the NOx exhaust amount increases, can be reduced within the range not exceeding the regulation value.

The SCR apparatus 40 has a function of converting NOx into nitrogen at an activation temperature at which the reduction catalyst is activated. However, when the temperature of the reduction catalyst is lower than the activation temperature, the function of converting NOx into nitrogen decreases (i.e., the purification rate decreases). Therefore, when the purification rate is less than a threshold value, the determining part 636 determines a scheduled NOx exhaust amount that is equal to or less than the scheduled NOx exhaust amount determined previously. The threshold value is a purification rate corresponding to the activation temperature, and is stored in the storage 62. For example, the determining part 636 specifies a threshold value by referencing the purification rate corresponding to the activation temperature stored in the storage 62, and when the purification rate is less than the threshold value, determines a scheduled NOx exhaust amount equal to or less than the previously determined scheduled NOx exhaust amount. By having the determining part 636 operate in this manner, it is possible to suppress an increase in the NOx exhaust amount when the temperature of the SCR apparatus 40 increases.

After determining the scheduled NOx exhaust amount, the determining part 636 determines at least one of the opening degree of the valve provided in the passage for recirculating the exhaust gas to the engine 10 and the opening degree of the turbocharger corresponding to the scheduled NOx exhaust amount. The opening degree of the valve is the opening degree of the EGR valve 30, and the opening degree of the turbocharger 20 is, for example, the opening degree of at least one of the turbine 21 and the compressor 22. For example, the determining part 636 references the storage 62 to determine at least one of the opening degree of the EGR valve 30 and the opening degree of a valve of the turbine 21 included in the turbocharger 20, associated with the scheduled NOx exhaust amount. As an example, the determining part 636 makes a determination to decrease the opening degree of the EGR valve 30 as the scheduled NOx exhaust amount becomes greater.

<Processing Sequence in the NOx Generation Amount Control Apparatus 60>

Figure 6:
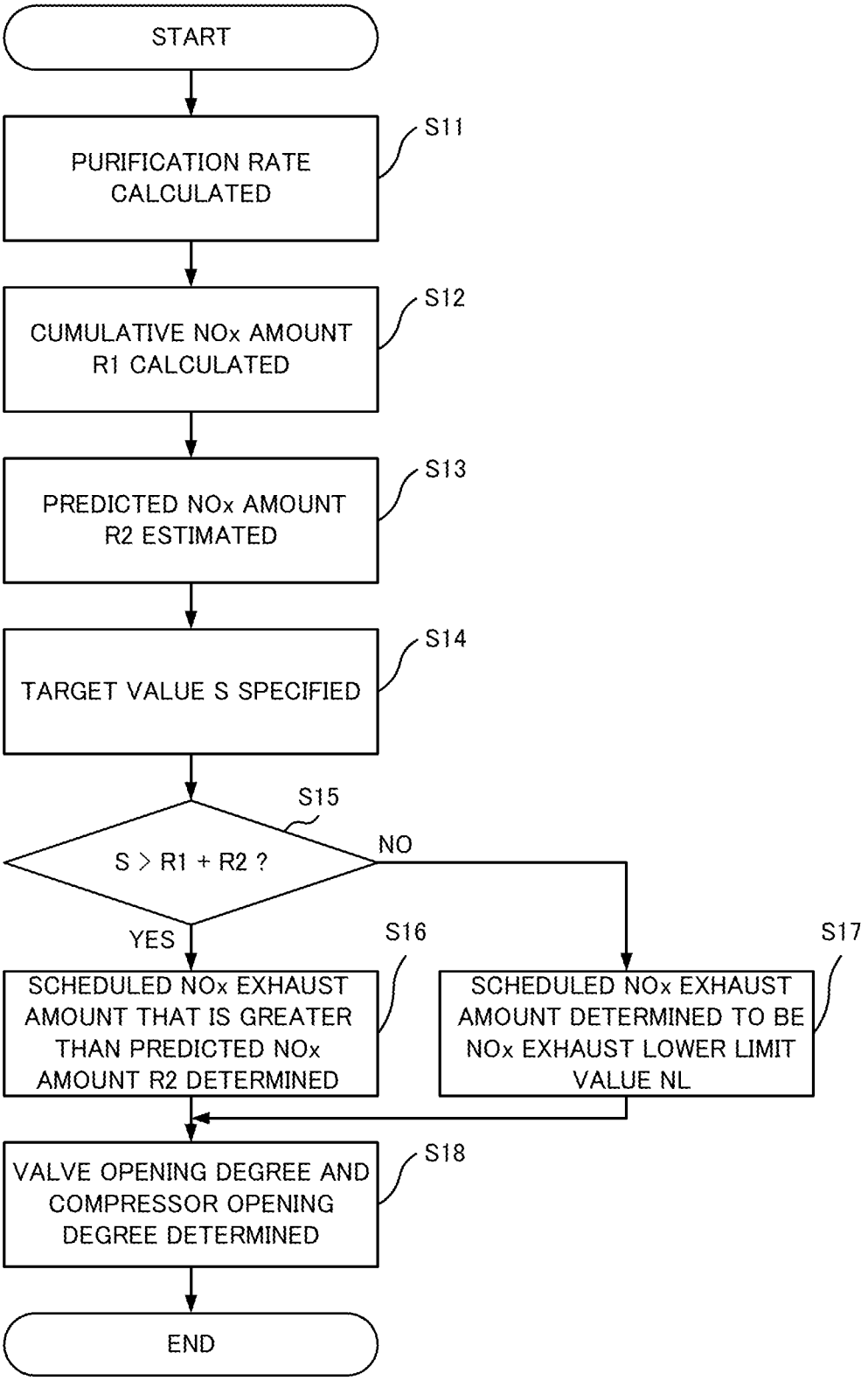
FIG. 6 is a diagram showing an example of a processing sequence in the NOx generation amount control device 60.

FIG. 6 is a diagram showing an example of a processing sequence in the NOx generation amount control device 60. The processing sequence shown in FIG. 6 shows, for example, the operation of determining the opening degree of the EGR valve 30 and the opening degree of the compressor 22 at the timing when a prescribed time interval has elapsed.

The exhaust amount calculating part 631 calculates the NOx exhaust amount based on the NOx concentration detected by the NOx sensor 50*a* and the exhaust amount of the engine 10. In addition, the exhaust amount calculating part 631 calculates the purification rate of the SCR apparatus 40 based on the difference between the NOx concentrations detected by the NOx sensor 50*a* and the NOx sensor 50*b* (S11). The cumulative amount calculating part 632 calculates a cumulative NOx amount R1 obtained by adding a plurality of NOx exhaust amounts calculated by the exhaust amount calculating part 631 (S12).

The estimating part 634 estimates the predicted NOx amount R2 at a prescribed timing based on the rotation speed of the engine 10 and the fuel injection amount stored in the storage 62 (S13). By referencing the storage 62, the specifying part 633 specifies the target value S of the cumulative NOx amount associated with the travel distance of the vehicle or the output value of the engine 10 (S14).

When the judging part 635 judges that the sum of the cumulative NOx amount R1 and the predicted NOx amount R2 does not exceed the target value S (YES in S15), the determining part 636 determines a scheduled NOx exhaust amount that is larger than the predicted NOx amount R2 (S16). On the other hand, if the judging part 635 judges that the sum of the cumulative NOx amount R1 and the predicted NOx amount R2 exceeds the target value S (NO in S15), the determining part 636 determines the NOx exhaust lower limit value NL as the scheduled NOx exhaust amount (S17). Then, the determining part 636 references the storage 62 to determine the opening degree of the EGR valve 30 and the opening degree of the compressor 22 associated with the scheduled NOx exhaust amount (S18).

<Effect of the NOx Generation Amount Control Apparatus 60>

As described above, the NOx generation amount control device 60 includes the exhaust amount calculating part 631 that calculates the NOx exhaust amount based on the NOx concentration detected by the NOx sensor 50*a* and the exhaust gas amount of the engine 10; the cumulative amount calculating part 632 that calculates the cumulative amount of NOx obtained by adding together a plurality of NOx exhaust amounts; the specifying part 633 that specifies the target value of the cumulative NOx amount associated with the movement distance of a moving body including the engine 10 or the output value of the engine 10; the estimating part that estimates the scheduled NOx amount indicating the predicted cumulative amount of the NOx for the prescribed time or prescribed movement distance, based on the rotation speed and the fuel injection amount of the engine 10; the judging part 635 that judges whether the sum of the scheduled NOx amount and the cumulative NOx amount exceeds the target value; and the determining part 636 that determines the scheduled NOx exhaust amount based on the judgment result of the judging part 635 and the difference between the NOx exhaust upper limit value and the target value and the cumulative NOx exhaust amount, and determines at least one of the opening degree of the EGR valve 30 and the opening degree of the turbocharger 20 corresponding to the scheduled NOx exhaust amount.

By configuring the NOx generation amount control device 60 in this manner, the NOx generation amount control device 60 can control the NOx generation amount of the engine 10 so as not to exceed each of a plurality of target values associated with the travel distance and the output value of the engine 10. Further, since the NOx generation amount control device 60 predicts the cumulative NOx amount at the timing when the prescribed time has elapsed based on the rotation speed of the engine 10 and the fuel injection amount for each prescribed time interval, the NOx generation amount control device 60 can perform control so as to emit an amount of NOx suitable for the travel pattern even when the travel pattern differs depending on the timing.

Further, when the NOx generation amount control device 60 determines that the cumulative NOx amount does not exceed the target value at the timing when the prescribed time has elapsed, the NOx generation amount control device 60 can lower the fuel consumption rate (i.e., improve the fuel consumption) by increasing the NOx exhaust amount within a range not exceeding the target value. That is, the NOx generation amount control device 60 controls the NOx generation amount so that the cumulative value of the NOx generation amount does not exceed the target value, and can improve the fuel consumption of the engine 10.

Although the embodiments of the present disclosure have been described above, the technical scope of the present disclosure is not limited to the embodiments described above, and various modifications and changes can be made without departing from the scope of the present disclosure. For example, all or a portion of the apparatus may be functionally or physically distributed and integrated in arbitrary units. Further, new embodiments resulting from arbitrary combinations of a plurality of embodiments are also included in the embodiments of the present disclosure. The effect of the new embodiment caused by the combination has the effect of the original embodiment.

What is claimed is:

1. A NOx generation amount control device comprising:

an exhaust amount calculating part that calculates a NOx exhaust amount based on a NOx concentration detected at a downstream side of a purification apparatus provided in an exhaust passage in which exhaust gas of an engine flows, and on an exhaust amount of the engine, at each prescribed time interval;

a cumulative amount calculating part that calculates a cumulative NOx amount obtained by adding together a plurality of NOx exhaust amounts;

a specifying part that specifies a target value for the cumulative NOx amount associated with a movement distance of a moving body including the engine or an output value of the engine;

an estimating part that estimates a predicted NOx amount indicating a predicted cumulative NOx amount at a prescribed timing or at a prescribed travel distance based on a rotation speed of the engine and a fuel injection amount;

a judging part that judges whether a sum of the predicted NOx amount and the cumulative NOx amount exceeds a target value; and a determining part that determines a scheduled NOx exhaust amount for each prescribed time interval based on a judgment result of the judging part, an upper limit value of NOx exhaust, and a difference between the target value and the cumulative NOx amount, and determines at least one of an opening degree of a valve provided in a passage for recirculating the exhaust gas to the engine and an opening degree of a turbocharger, corresponding to the scheduled NOx exhaust amount.

2. The NOx generation amount control device according to claim 1, wherein the determining part determines a NOx exhaust lower limit value which indicates the minimum generation amount of NOx generated when the engine is operated in order to drive a vehicle to be a scheduled NOx exhaust amount when the judging part judges that the sum of the NOx integrated amount and the predicted NOx amount exceeds the target value.

3. The NOx generation amount control device according to claim 1, wherein the determining part determines, as the scheduled NOx exhaust amount at a current timing, the scheduled NOx exhaust amount whose sum with the NOx integrated amount is closest to the target value and not exceeding the target value among a plurality of scheduled NOx exhaust amounts determined after the engine starts operating.

4. The NOx generation amount control device according to claim 1, wherein when the judging part judges that the sum of the cumulative NOx amount and the predicted NOx amount does not exceed the target value, the determining part determines the predicted NOx amount to be a value smaller than the difference between the target value and the cumulative NOx amount and larger than the predicted NOx amount with the exhaust upper limit value as an upper limit.

5. The NOx generation amount control device according to claim 1, wherein the exhaust calculating part calculates a NOx purification rate with a purification apparatus, based on the NOx concentration detected upstream of the purification apparatus and the NOx concentration detected downstream of the purification apparatus, and the estimating part determines the predicted NOx amount downstream of the purification apparatus further based on the purification rate.

6. The NOx generation amount control device according to claim 5, wherein when the purification rate is less than a threshold value, the determining part determines the scheduled NOx exhaust amount to be equal to or less than the scheduled NOx exhaust amount previously determined.

7. The NOx generation amount control device according to claim 6, wherein the threshold value is a purification rate corresponding to an activation temperature at which a reduction catalyst included in the purification apparatus is activated, and the determining part specifies the threshold value by referencing the purification rate corresponding to the activation temperature stored in the storage.

8. The NOx generation amount control device according to claim 1, wherein the target value is the same value as a regulation value of the NOx exhaust amount or a value obtained by multiplying the regulation value by a prescribed ratio, and the specifying part acquires the movement distance or the output value of the engine stored in the storage at each prescribed time interval, and identifies the target value by referencing a target value table in which the movement distance or the output value of the engine and the target value are associated with each other, the target value table being stored in the storage.

9. The NOx generation amount control device according to claim 1, wherein the cumulative amount calculating part calculates the cumulative NOx amount obtained by adding together a plurality of NOx exhaust amounts calculated by the exhaust amount calculating part at each prescribed time interval from the start of the engine to a current timing.

10. The NOx generation amount control device according to claim 1, wherein the estimating part calculates an integrated value of the NOx exhaust amount based on the engine speed and the fuel injection amount from the current timing to a timing before the prescribed time interval, and adds the calculated integrated value to the cumulative NOx amount at the current timing, thereby estimating the scheduled NOx amount from the current timing to a timing after the prescribed time interval.

11. The NOx generation amount control device according to claim 1, wherein the judging part judges whether the target value is exceeded at a timing when the prescribed time has elapsed from the current timing.

12. The NOx generation amount control device according to claim 1, wherein the determining part references the storage to determine at least one of an opening degree of the valve, an opening degree of the turbine of the turbocharger, and an opening degree of a compressor of the turbocharger, which are associated with the scheduled NOx exhaust amount.

* * * * *